US012742458B2

(12) United States Patent
Paris

(10) Patent No.: US 12,742,458 B2
(45) Date of Patent: Sep. 22, 2026

(54) TORSO AERATOR

(71) Applicant: John Paris, Warrenton, MO (US)

(72) Inventor: John Paris, Warrenton, MO (US)

( * ) Notice: Subject to any disclaimer, the term of this patent is extended or adjusted under 35 U.S.C. 154(b) by 0 days.

(21) Appl. No.: 18/544,156

(22) Filed: Dec. 18, 2023

(65) Prior Publication Data

US 2024/0200572 A1 Jun. 20, 2024

Related U.S. Application Data

(60) Provisional application No. 63/387,842, filed on Dec. 16, 2022.

(51) Int. Cl.

| | |
|---|---|
| ***F04D 29/52*** | (2006.01) |
| ***F04D 25/08*** | (2006.01) |
| ***F04D 29/66*** | (2006.01) |

(52) U.S. Cl.

CPC ..... *F04D 29/522* (2013.01); *F04D 25/08* (2013.01); *F04D 29/664* (2013.01)

(58) Field of Classification Search

CPC ..... F04D 29/522; F04D 25/08; F04D 29/664
See application file for complete search history.

(56) References Cited

U.S. PATENT DOCUMENTS

| | | | | |
|---|---|---|---|---|
| 2013/0108481 | A1 | 5/2013 | Hoye | |
| 2016/0369819 | A1* | 12/2016 | Lofy | F04D 29/424 |
| 2018/0372351 | A1 | 12/2018 | Lupi | |
| 2019/0041057 | A1* | 2/2019 | Paras | F23G 5/44 |
| 2020/0032815 | A1* | 1/2020 | Paris | F04D 25/084 |
| 2022/0010799 | A1* | 1/2022 | Park | F24F 13/10 |

FOREIGN PATENT DOCUMENTS

WO WO-2007140432 A2 * 12/2007 ..... G01H 17/00

OTHER PUBLICATIONS

US Dept. of Interior, Design of Small Dams, 1987, 365, 366. 370, 377, 3rd edition, US Government, Washington, DC, USA.
Lindberg, M. R., Open Channel Flow, Civil Engineering Reference Manual, 1992, 5-7, 5-13, 5-16, item 23, 6th Ed., Professional Publications, Belmont, CA.
US Army Corps of Engineers Hydraulic Engineering Center, Hydrologic Modeling System—Spillways, 2024, 1-6, US Army, Davis, CA.
Knowledge Institute of Technology, Open Channel Hydraulics, 2-4, 2012, Knowledge Institute of Technology, Tamilnadu, India.
Shivohum2015, Ogee Spillway, 2017, 1-3, Steemit, Wilmington, DE.

* cited by examiner

*Primary Examiner* — Aaron R Eastman
(74) *Attorney, Agent, or Firm* — Charles McCloskey

(57) ABSTRACT

A torso aerator has a cylinder with two ends, a cover upon at least one end, a plurality of apertures in each cover, a fan upon the cylinder, electrical supply to the fan, and at least one padding upon the cylinder spaced away from the fan. The cylinder has a wall between the two ends and the fan has a position generally centered upon the wall with fluid communication into the cylinder. The fan draws air through the apertures into the cylinder and then exhausts the air from the cylinder upon the body of a user using the aerator. The fan has a plurality of speeds that a user may select. The padding joins to the wall and prevents the cylinder from rolling. The padding also allows a user to adjust the orientation of the fan towards the torso of the user.

5 Claims, 2 Drawing Sheets

TORSO AERATOR

CROSS-REFERENCE TO RELATED APPLICATION

This non-provisional application claims priority to the pending provisional application Ser. No. 63/387,842 filed on Dec. 16, 2022 and all applications are owned by the same inventor.

BACKGROUND OF THE INVENTION

The torso aerator generally relates to personal drying equipment and more specifically to an aerator that props up the legs of a user and directs its airflow to the user.

People seek to cool and to dry themselves from time to time. That may occur after bathing or swimming, following a rainstorm or clearing snow, during recovery from medical procedures, and the like where a person must shed moisture from herself or her clothing. People have made and used fans for millennia. Early fans had staff waving palm branches before very important people. In later centuries, folded paper arrayed from a common center point and sheets of textiles appeared as fans. Many times, these devices had a person operating them herself. With the development of alternate power sources, primarily electric utility service, fans also developed similarly.

A modern fan operates as a powered machine used to create flow within a fluid, typically a gas such as air. A fan has a rotating arrangement of vanes or blades which act upon the air. The rotating assembly of blades and hub has the name of an impeller, a rotor, or a runner. Usually, a fan fits within a housing or a case. This may direct the airflow and increase safety by preventing objects from contacting the fan blades. Many modern fans use electric motors, but other sources of power operate fans, including hydraulic motors, hand cranks, internal combustion engines, and solar power.

Mechanically, a fan can use any revolving vane or vanes used for producing currents of air from the fan. Fans produce air flows with high volume and low pressure—although higher than ambient pressure—, as opposed to compressors which produce high pressures at a comparatively low volume. A fan blade often rotates when exposed to an air fluid stream, and devices that take advantage of this, such as anemometers and wind turbines, often have designs similar to that of a fan.

Typical applications for a fan include climate control and personal thermal comfort, such as an electric table fan or a floor fan, vehicle engine cooling systems, such as in front of a radiator, machinery cooling systems, such as inside computers and audio power amplifiers, ventilation of structures, fume extraction from hoods and rooms, winnowing of grain, such as separating chaff of cereal grains, removing dust, such as suction from a vacuum cleaner, drying usually in combination with a heat source, and to provide draft for a fire, among other things.

While fans often cool people, they do not actually cool the air as electric fans may warm it slightly due from the warmth of their motors. Fans operate by evaporative cooling of sweat from a person's skin and by increased heat convection into the surrounding air due to the airflow from the fans. Thus, fans become ineffective at cooling the body if the surrounding air is near body temperature and contains high humidity. During periods of extremely high heat and humidity, governments actually advise against the use of fans.

DESCRIPTION OF THE PRIOR ART

As described above, a palm frond and a paper fan call for a person to wave them. When the person ceases waving the fan, its cooling ceases. With a textile sheet, a person may use two hands to wave it. And when the person stops doing so, the breeze from the moving sheet stops. Manually powered fans often collapsible readily for transport or a person may even make one from nearby paper or other materials. But manually powered fans stop their effects the instant manual power stops.

Some battery powered personal fans have a compact form. The form folds or otherwise stows for transport and later reuse. Such fans often rest upon a person's leg or arm and guide air towards a person's upper body. The leg or arm position of such a fan limits surfaces that may feel its airflow to those substantially perpendicular to that airflow. Other fans operate as cooling devices. These devices attach to a person's belt for storage and transportation then a person grasps a handle to direct the air flow. Akin to a paper fan, these devices call for a person to hold them and guide the air flow thus occupying one hand. Other devices have a fan upon a battery pack suspended from a lanyard. A person grips a handle of such a fan for temporary cooling and then lets the fan suspend from the lanyard when not in use. Once more, this devices occupies a hand of a person during its use.

Prior art fans having their challenges to hold in a fixed position for long periods of time. Manual fans in time lose the strength of the hand and the arm of the person waving them. Electrically powered fans often call for a stable base to support them during a period of extended use. From time to time, a person may undergo a medical procedure. When surgery or even an injury has occurred to sensitive areas of a person, often ice packs may prove insufficient or dangerous to have on those sensitive areas. People may attempt to use a prior art fan during medical recovery but that often causes discomfort and encourages a person not to use a fan. A person may have to attain a supine position or recline so that the prior art fan has support and a consistent angle of air flow.

In light of the foregoing, there is a need to have a device that can provide cooling from a fan such that a fan can be in a comfortable position without the use of one's hands.

The Torso Aerator overcomes the above-mentioned disadvantages and drawbacks of the prior art. As such, the general purpose of the present invention, which will be described subsequently in greater detail, is to provide new and improved Torso Aerator which has all the advantages of the prior art mentioned heretofore and many novel features that result in Torso Aerator which are not anticipated, rendered obvious, suggested, or even implied by the prior art, either alone or in any combination thereof.

SUMMARY OF THE INVENTION

The torso aerator has a cylinder with two ends, a cover upon at least one end, a plurality of apertures in each cover, a fan upon the cylinder, electrical supply to the fan, and at least one padding upon the cylinder spaced away from the fan. The cylinder has a wall between the two ends and the fan has a position generally centered upon the wall with fluid communication into the cylinder. The fan draws air from within the cylinder and exhausts the air upon the body of a person using the invention. The apertures admit replacement air into the cylinder as the fan draws it. The fan has a plurality of speeds that a user may select. The padding joins to the wall and prevents the cylinder from rolling. The padding also allows a user to adjust the orientation of the fan towards the torso of the user.

There has thus been outlined, rather broadly, the more notable features of the invention in order that the detailed description thereof that follows may be better understood and that the present contribution to the art may be better appreciated. The present invention also includes an on/off switch, speed control, two sets of padding, edge conditions of the apertures that lessen whistling and other air noises, a grill upon the fan, and alternate battery power supply. Additional features of the invention will be described hereinafter, and which will form the subject matter of the claims attached.

The torso aerator of the invention has its cylindrical form with its cover having preferably seven apertures and has an open volume for an interior of the cylinder. The padding of the invention provides comfort for a user, and positioning of the fan towards the user. The fan has its components that include a fan blade powered by a motor itself operated through an actuator. The fan has its location towards the middle of the cylinder for its airflow to draw air into the apertures or openings of the covers, circulate it within the cylinder, and then exhaust the air from the fan towards the body of a user.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a torso aerator that provides a comfortable and efficient airflow to a desired area for healing of the torso and perineum of a person.

Another object is to provide such a torso aerator that provides a comfortable and efficient cooling, heating, or drying of a desired area for those people recovering from surgery, injury, childbirth, and the like with a need for healing of a wound in a sensitive area.

Another object is to provide such a torso aerator that is capable of manufacturing and distribution at a price suitable for the patients, prescribing practitioners, consumers, supply houses, retailers, distributors, and catalogs.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
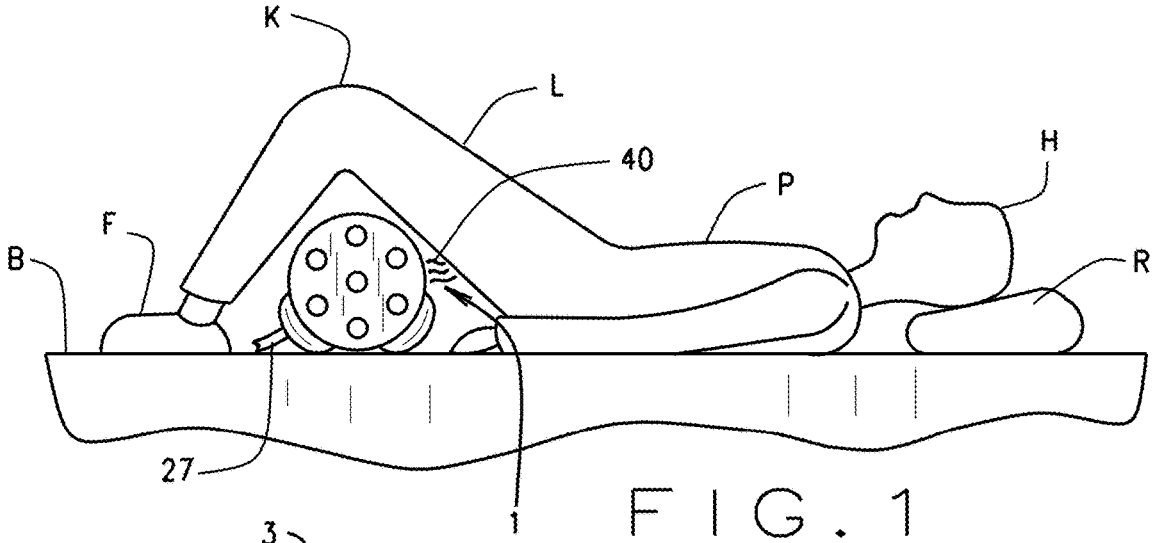
FIG. 1 is an environmental view of the preferred embodiment of the invention.

The present invention overcomes the prior art limitations by providing a torso aerator that attains a stable position beneath one or two legs of a person, or user, draws air into itself from the atmosphere, and exhausts the air upon the body of a user. A preferred embodiment of the present invention 1 appears as shown in FIG. 1 with a person P in a supine position with her head H resting upon a pillow R. The person for this description seeks recovery from a medical procedure in the pelvic area or upper thighs. The person has her legs L elevated upwardly with her knees K bent as shown. The legs continue downwardly from the knees to her feet F upon a supporting surface, such as a bed B. The supporting surface B has receives the person's back and the pillow R as shown. Beneath her knees the person has the invention 1 in use with its power cord 27 extending to the left into the background. The invention has an overall cylindrical form with an end shown here. The person, or attending medical staff, may roll the invention into position so that the invention's fan, not shown, aims an airflow, shown as 40, towards an area of the person recovering from a medical procedure. Using air from within cylinder of the invention, the fan then blows or exhausts air to the vicinity of the healing area and the air then dissipates into the atmosphere.

Figure 2:
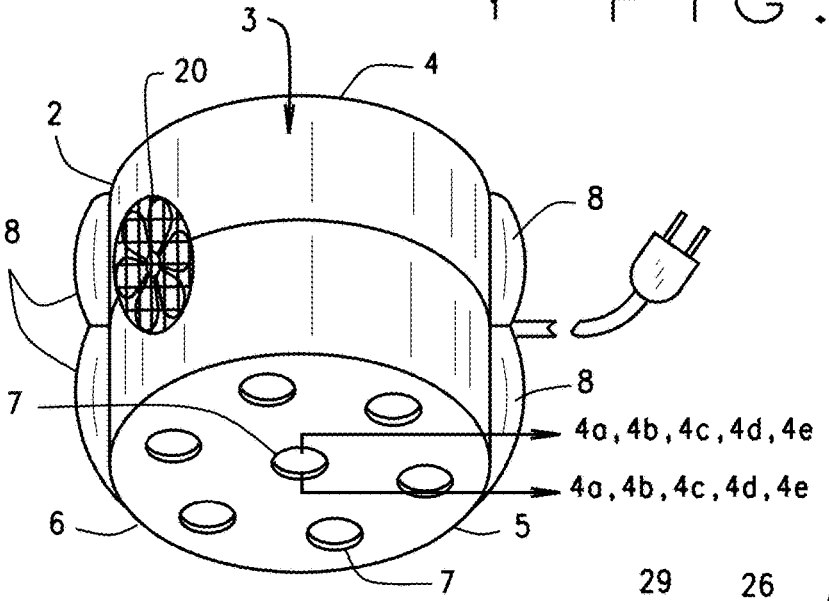
FIG. 2 is a perspective view of the invention.

Turning to FIG. 2, a perspective view of an exemplary torso aerator of the invention 1 appears without a nearby user, or person. The invention 1 provides a directed fanning of outward airflow to a desired location of a person as previously shown in FIG. 1. The torso aerator 1 further provides a comfortable and efficient cooling or drying of a desired area for those persons who have had surgery, injury, childbirth, and the like, and have a need for healing of a wound in a sensitive part of the pelvic region or upper thigh area.

The personal fan device of the invention 1 has a cylinder 2 and a fan assembly 20. The cylinder has an elongated, round form made of a wall 3 with a hollow interior. The wall has an exterior surface shown in this figure and an interior surface concealed within the invention. Mutually parallel and spaced apart, the cylinder has two opposite ends with an end 4 in the background, and shown partially concealed, and another end 5 in the foreground with a cover 6 upon it. In an alternate embodiment, the end 4 also has a cover 6.

The cylinder 2 has a preferred length of twenty-six inches, however other lengths may prove useful including, but not limited to, twenty-four inches, and thirty inches. The cylinder 2 preferably has a diameter of fourteen inches, while other diameters may prove useful including, but not limited to, ten inches, and eighteen inches. As described above the cylinder 2 has its round cylindrical shape, however the applicant foresees other cross sections such as elliptical, square, and rectangular.

In the preferred embodiment of the invention, the invention has its ends 4, 5, partially blocked, thus allowing exhaust of air out of the invention after its intake from within the interior of the invention within the wall 3. A first of the covers 6 has a removable coupling to the other end 5 of the cylinder 2 here shown in the foreground of the figure. A second cover 6, not shown, also has a removable coupling to the back of the cylinder 2 as at end 4. The covers 6 upon the ends 4, 5 of the cylinder 2 have a preferred one-eighth inch thickness, however the applicant foresees other thicknesses including, but not limited to, one-sixteenth inch and one-fourth inch. In an alternate embodiment, the end 4 in the background of the figure has an open condition and thus allows a user to access the interior of the invention.

Each cover 6 of the cylinder 2 has a plurality of apertures 7 therethrough. This figures shows seven apertures 7 though other numbers of apertures and arrangements thereof may occur. The apertures 7 of the covers 6 preferably have a diameter of one inch, however other diameters may occur including, but not limited to, one-half inch and two inches. The apertures have an edge condition, or rim, denoting the shape of the cover merging into each aperture. The edge condition may be square as from a punch operation as later shown in FIG. 4*e*. The edge condition may also have a shape that lessens noise from air flow such as rounded, parabolic, ogee, and beveled as later shown in FIGS. 4*a-d*. The covers 6 themselves have a diameter slightly less than the ends 4, 5 that permits a snug fits of the cover to the wall 3. The covers 6 preferably have a diameter of fourteen inches, however other diameters may occur including, but not limited to, ten inches and eighteen inches.

Upon the exterior of the cylinder's wall 3, the invention has at least one set of padding 8. This figure shows two opposite sets of padding 8. The padding joins or adheres to the wall for long term use. The padding 8 has a preferred foam construction though other types of padding may have use including, but not limited to, cotton, and down feathering. The padding 8 provides comfort to a user's limb, such as a leg L, resting upon the invention 1 as shown in FIG. 1. The padding also prevents the cylinder 2 from rolling away when unattended and reminds the user of the cylinder's orientation when preparing the invention for use 1. The padding provides comfort and longer duration of using of the invention 1, or torso aerator.

As described above, the invention has its fan assembly 20 in the wall 3 between the padding 8. More particularly, the fan assembly 20 has its position near one set of padding 8, here shown to the left, and opposite the cord 27. The position of the fan assembly allows a person to aim its airflow to a desired area. The position of the fan assembly then cooperates with the nearby padding to prevent the fan assembly's weight, and any vibration, from rolling the cylinder out of alignment towards the desired area. The fan assembly preferably has electric utility power, here shown by a cord.

Figure 3:
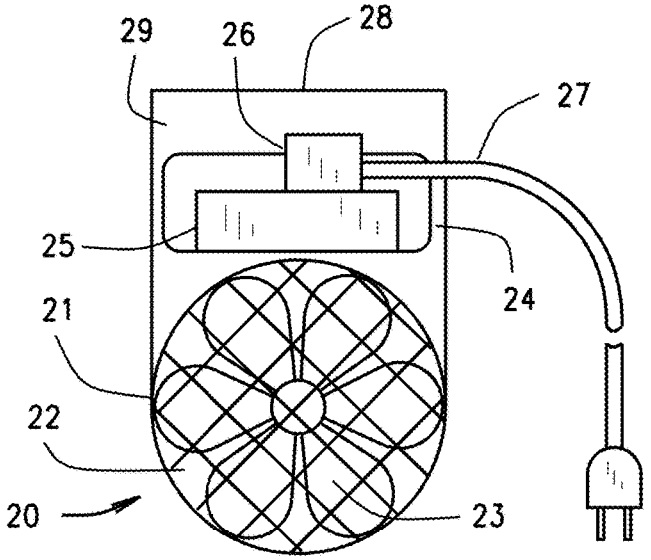
FIG. 3 is a detailed view of the fan of the invention.

The fan assembly appears in more detail in FIG. 3. Here, the fan assembly has its housing 21 than encloses the assembly and provides for its connection to the wall 3 as in FIG. 2. Upon the housing, the assembly has a grill 22. The grill permits air to flow out of the assembly and deters bed linens and other objects from entering into the assembly. Inside of the grill, the assembly has an impeller 23 of at least three blades upon a common center. The impeller creates an air flow out of the plane of this figure and perpendicular to the plane of this figure.

Upwardly in this figure and away from the impeller, the fan assembly has a case 24 that receives a motor 25. The motor then couples to an actuator 26 which includes a switch, not shown, and the actuator allows current from the power source, such as utility service to flow through a cord 27 to the motor 25 or to prevent current from flowing. The actuator 26 has a preferred form of a button, however other types of actuators may also have uses including, but not limited to, slide actuators, toggle switch, and the like. The cord 27 preferably carries alternating current, but other power such as direct current, and other power sources may also see use, including, but not limited to, rechargeable battery, disposable battery, solar cell, and the like. The motor 25 and the cord's terminus have a configuration within the interior of the housing 21 of the fan assembly 20. The motor, the actuator and the cord's terminus fit with a case 24 while the button or other contact of the actuator extends from the case. Above the actuator, the case 24 has a thin gap as a 29 beneath a cover 28. The cover permits a user to press a button or other contact of the actuator.

The impeller 23 has its motion and direction of rotation controlled by the motor 25 through its coupling to the motor 25. The motor operates between 5 revolutions per minute and 2100 revolutions per minute. Upon actuation of the motor 25 by the actuator 26, the impeller 23 rotates and creates air flow, preferably out from the fan assembly 20 and the cylinder 2 towards a user. The outward airflow to the patient, or user, assists to promote healing as the airflow dries and cools a wound. The housing 21 of the fan assembly 20 fits into the wall 3 about the center. The fan assembly 20 connects to the outside surface of the cylinder 2 between the end 4 and the other end 5 as previously shown in FIG. 2. The fan assembly does not have any padding 8 upon it or near it. Alternatively, the fan assembly may fit into the end 4 of the cylinder 2 and rest within the cylinder 2. The housing 21 of the assembly may also have its own padding 8 for vibration dampening and sound suppression. The impeller 23 preferably has a diameter of six inches, however other diameters may also see use, including, but not limited to, four inches, eight inches, and ten inches. As suggested in the figures, the diameter of the impeller 23 must be less than the diameter of the cylinder 2.

The cylinder aids a person in propping up the person's legs. The person's legs rest upon the cylinder preventing it from rolling away. The cylinder 2 also positions the fan assembly 20 proximate the pelvis of the person. Noting the arrangement of a person's legs, as previously shown in FIG. 1, the fan assembly aimed towards the person's pelvis draws air from a volume of similar size to that of the cylinder. A person's legs and pelvis form a small volume between them. The applicant proceeds with the volume near the person during usage approximately that of the cylinder, or approximately one cubic foot. In the era of Severe Acute Respiratory Syndrome coronavirus 2, or its common name COVID, the Centers for Disease Control and American Society of Heating, Refrigerating and Air-Conditioning Engineers recommend at least two air changes per hour. Thus, the fan assembly moves at least 0.02 cubic feet per minute of air. The fan assembly also seeks to minimize noise, power demand, and dispersing of contaminants. The fan assembly has a maximum air flow of 190 cubic feet per minute as it utilizes at least two speed, that is, rotation settings. The fan assembly emits no more than 31 decibels of sound, or 31 dB, as it quietly operates. To augment its quiet operation, the fan assembly preferably moves less than 100 cubic feet per minute of air.

As suggested in FIG. 2, each aperture has an edge condition. FIGS. 4*a*-4*e* are edge conditions of an aperture. Edge conditions alter the flow of a gas over that edge. Here the invention operates as quietly as possible to promote long use and healing of the person P, and edge conditions play a role in both.

Figure 4A:
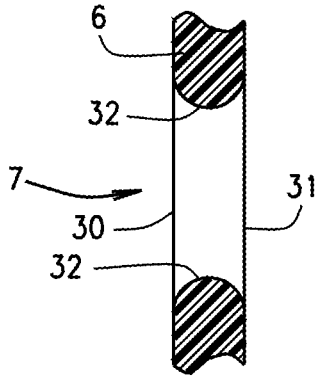
FIG. 4*a* is a section view of an aperture of the invention.

FIG. 4*a* shows a rounded edge condition of an aperture 7 in a cover 6. Here, aperture 7 has an outer rim 30 and an opposite inner rim 31 of the same diameter for a round aperture, or of the same width for a non-round aperture. The cover 6 has a rounded edge 32 with a constant radius to the rounded edge 32 spans from the other rim 30 to the inner rim 31 as shown.

Figure 4B:
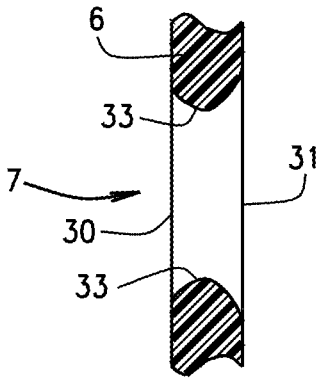
FIG. 4*b* is a section view of an alternate embodiment of an aperture of the invention.

FIG. 4*b* is a second edge condition, or alternate embodiment, for an aperture 7. This edge condition has a parabolic edge. As before, the aperture 7 has an outer rim 30 and an opposite inner rim 31 of the same diameter. The cover 6 has a parabolic edge 33 that spans from the outer rim 30 to the inner rim 31 of the aperture 7 as shown in the figure.

Figure 4C:
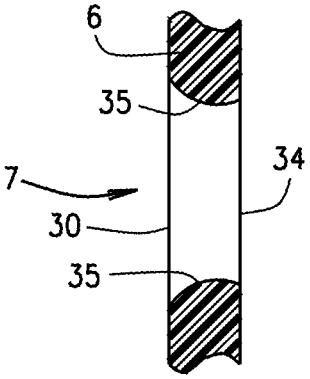
FIG. 4*c* is a section view of an alternate embodiment of an aperture of the invention.

FIG. 4*c* is an alternate embodiment, or a third edge condition, for an aperture 7 again in one of the covers 6. In this alternate embodiment, the aperture 7 has an outer rim 30 and an opposite inner rim 34 of a narrower diameter than the outer rim. Here, the cover 6 has an ogee edge 35 spanning from the outer rim 30 to the inner rim 34 of the aperture 7 as shown in the figure. As a reminder, an ogee comes from hydraulics where an aqueous fluid attains a catenary curve when it falls under gravity. An ogee structure has a catenary curve shape that supports and guides falling water, often seen in downspouts on buildings, spillways, and weirs.

Figure 4D:
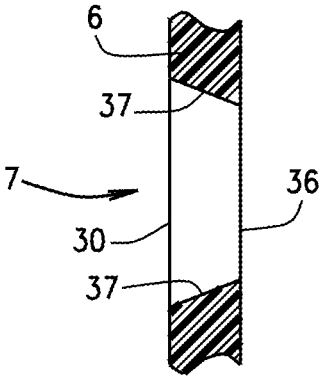
FIG. 4*d* is a section view of an alternate embodiment of an aperture of the invention.

Then FIG. 4*d* is a fourth edge condition for an aperture 7, another embodiment. Unlike the previous three edge conditions as in FIGS. 4*a-c* with degrees of curvature, this edge condition has a flat surface between the outer rim and its opposite inner rim 36, and the outer rim 30 has a larger diameter than the inner rim 36. A flat, beveled edge 37 joins the two rims as it spans between them for the aperture 7 as shown in the figure.

Figure 4E:
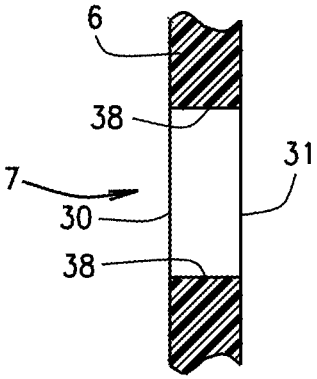
FIG. 4*e* is a section view of an alternate embodiment of an aperture of the invention.

And, FIG. 4*e* is another alternate embodiment with a fifth edge condition for an aperture. This fifth edge condition occurs from a square punch into the cover 6. Here, the aperture has an outer rim 30 and an opposite inner rim 31 of the same diameter connected by a flat edge 38. The flat edge 38 has a mutually perpendicular orientation to both rims as shown.

In another embodiment, the torso aerator has a cylinder with two ends and a wall between the ends while the cylinder has its length. The invention then has two covers that each fit into one of the ends and each cover has many, or a plurality of apertures. Inside the invention, it has a fan assembly installing into the wall generally centered between the ends so the fan assembly draws air into the cylinder through the plurality of apertures. The invention then has at least one padding joined to the wall so the at least one padding prevents rotation of the cylinder during usage and that the at least one padding allows for aiming of the fan assembly during usage. Then the fan assembly exhausts air out from the aerator, so the invention dries and ventilates a surface of a person having a body utilizing the torso aerator near the body of the person. To promote quiet operation, the invention operates at less than 50 decibels. Then each cover has a round shape and more particularly the fan assembly operates at less than 31 decibels as it exhausts out of the wall. In a refined form of this embodiment, the invention has two paddings, and its fan assembly has a position upon the wall near one of the paddings, so it exhausts air out of the wall to a desired location while preventing the fan assembly rotating the cylinder. Then the second, or other, of the paddings has its own position upon the wall and spaced away from the first, or the one, of the paddings. Along with round covers, the invention has each of the apertures with an edge condition within the cover. That edge condition may take the form of rounded, parabolic, ogee, beveled, and square as shown in FIGS. 4*a* to 4*e*. During operation, the fan assembly operates from about 0.02 cubic feet per minute to about 190 cubic feet per minute. When quiet operation becomes premium, the fan assembly operates from about 85 cubic feet per minute to about 105 cubic feet per minute as the motor turns from about five revolutions per minute to about 2100 revolutions per minute.

In another embodiment, the torso aerator combines a fan assembly that exhausts air out of the torso aerator as it dries and ventilates a surface of a person having a body near a selected part of the body for healing. This embodiment has its fan assembly installing in a wall where the wall curves into a cylinder. That cylinder has two ends and a length, and the wall extends between those ends. The invention continues with two covers where each cover fits into one of the ends and has a plurality of apertures. The plurality of apertures admits air into the cylinder drawn by the fan assembly. Then the invention has at least one padding joined to the wall that prevents rotation of the cylinder during its use and assists for aiming of the fan assembly. Here, the torso aerator operates at less than 50 decibels. As part of its construction, the invention has its covers being mutually parallel and spaced apart, and the fan assembly having a centered position between the ends. Looking more closely at the invention, each cover has a round shape and each aperture has an edge condition within the cover. The edge conditions may have a shape of rounded, parabolic, ogee, beveled, and square. Where quiet operation becomes key, the fan assembly operating at less than 31 decibels. As a reminder, the fan assembly exhausts air out of the wall. The fan assembly operates from about 0.02 cubic feet per minute to about 190 cubic feet per minute. More particularly for quieter settings, the fan assembly operating from about 85 cubic feet per minute to about 105 cubic feet per minute of air flow. The fan assembly includes an impeller, a motor operatively engaging the impeller, an actuator operatively engaging the motor, and a housing containing the impeller and the motor. The motor turns from about five revolutions per minute to about 2100 revolutions per minute. Viewed from the outside, this embodiment has two of the paddings, the fan assembly positioned upon the wall near one of the paddings to prevent the fan assembly rotating the cylinder, and the other of the paddings spacing away from the one of the paddings. The fan assembly exhausts air out of the wall from the cylinder to a desired place upon a person for healing.

And in another embodiment, the torso aerator has a cylinder having two round ends and a wall between the ends, and the cylinder has a length. Looking beyond the cylinder, the invention has two round covers, that each fit into one of the ends and a plurality of apertures in each cover. The invention moves air with a fan assembly installed in the wall generally centered between the ends, and it draws air into the cylinder through the plurality of apertures. Two paddings of the invention join to the wall, preventing rotation of the cylinder, and allow for aiming of the invention and its fan assembly during use. As before, the fan assembly exhausts air out of the aerator, so the invention dries and ventilates a surface of a person having a body near a desired part of the body. For quiet operation near a person, the invention operates at less than 50 decibels. In more detail, the invention has the fan assembly positioned upon the wall near one of the paddings, so it exhausts air out of the wall to a desired location upon a person and prevents the fan assembly rotating the cylinder during usage. The other of the paddings has its position upon the wall and spaced away from the one of the paddings. Each aperture has an edge condition within the cover and that edge condition takes the form of one of rounded, parabolic, ogee, beveled, and square. The fan assembly operates from about 0.02 cubic feet per minute to about 190 cubic feet per minute. More particularly for quiet, the fan assembly operates below 31 decibels as it exhausts air out of the wall, from about 85 cubic feet per minute to about 105 cubic feet per minute, and the motor turns, or rotates, from about five revolutions per minute to about 2100 revolutions per minute.

From the aforementioned description, a torso aerator has been described. The torso aerator is uniquely capable of drawing air from a wound or other site of healing upon a person and orienting the air flow at a desired angle to the wound or other site of healing. The torso aerator and its various components may be manufactured from many materials, including but not limited to, poly-vinyl chloride (PVC), aluminum, transparent polymers, steel, opaque polymers, ferrous and non-ferrous metal foils, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials, and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods, and systems for carrying out the several purposes of the present invention. Therefore, the claims include such equivalent constructions insofar as they do not depart from the spirit and the scope of the present invention.

I claim:

1. A torso aerator comprising:

a cylinder having two ends and a wall between said ends, said cylinder having a length;

two covers, each cover fitting into one of said ends, each cover having a plurality of apertures;

a fan assembly installing in said wall centered between said ends, said fan assembly drawing air into said cylinder through said plurality of apertures;

at least one padding joined to said wall wherein said at least one padding prevents rotation of said cylinder during usage and wherein said at least one padding allows for aiming of said fan assembly during usage;

said fan assembly exhausting air from said aerator, wherein said torso aerator is adapted to dry and to ventilate a surface of a person having a body utilizing said torso aerator proximate the body of the person;

each cover being round; and each of said plurality of apertures having an edge condition being an ogee.

2. The torso aerator of claim 1 wherein said fan assembly operates from 0.02 cubic feet per minute to 190 cubic feet per minute.

3. A torso aerator comprising:

a fan assembly exhausting air out of said torso aerator, wherein said torso aerator is adapted to dry and to ventilate a surface of a person having a body utilizing said torso aerator proximate the body of the person;

said fan assembly installed in a wall, said wall curving into a cylinder;

said cylinder having two ends and a length, and said wall extending between said ends;

two covers, each cover fitting into one of said ends, each cover having a plurality of apertures;

said plurality of apertures admitting air into said cylinder drawn by said fan assembly;

at least one padding joined to said wall wherein said at least one padding prevents rotation of said cylinder during usage and wherein said at least one padding allows for aiming of said fan assembly during usage;

said covers being mutually parallel and spaced apart;

said fan assembly having a centered position between said ends;

each cover being round;

each of said plurality of apertures having an edge condition being an ogee; and said fan assembly exhausting air out of said wall.

4. The torso aerator of claim 3, further comprising:

said fan assembly including an impeller, a motor operatively engaging said impeller, an actuator operatively engaging said motor, and a housing containing said impeller and said motor;

two of said paddings;

said fan assembly positioned upon said wall spaced away from one of said paddings and said one of said paddings is adapted to prevent said fan assembly rotating said cylinder; and said paddings mutually spacing apart.

5. A torso aerator comprising:

a cylinder having two round ends and a wall between said ends, said cylinder having a length;

two round covers, each cover fitting into one of said ends, each cover having a plurality of apertures;

a fan assembly in said wall generally centered between said ends, said fan assembly drawing air into said cylinder through said plurality of apertures;

two paddings joined to said wall wherein said paddings prevents rotation of said cylinder during usage and wherein said paddings allow for aiming of said fan assembly during usage;

said fan assembly exhausting air out of said aerator, wherein said torso aerator is adapted to dry and to ventilate a surface of a person having a body utilizing said torso aerator proximate the body of the person;

said fan assembly positioned upon said wall near one of said paddings wherein said fan assembly is adapted to exhaust air out of said wall;

wherein one of said paddings is positioned upon said wall and spaced away from the other said paddings; and each of said plurality of apertures having an edge condition being an ogee.

* * * * *